US006304195B1

(12) United States Patent
Bruno

(10) Patent No.: US 6,304,195 B1
(45) Date of Patent: Oct. 16, 2001

(54) DEVICE FOR ALTERING THE COURSE OF A BOAT

(76) Inventor: Marcel Bruno, Hameau de La Tour, B. P. 47, 83310 Grimaud (FR)

( * ) Notice: Subject to any disclaimer, the term of this patent is extended or adjusted under 35 U.S.C. 154(b) by 0 days.

(21) Appl. No.: 09/380,136

(22) PCT Filed: Feb. 18, 1998

(86) PCT No.: PCT/FR98/00317

§ 371 Date: Nov. 8, 1999

§ 102(e) Date: Nov. 8, 1999

(87) PCT Pub. No.: WO98/38083

PCT Pub. Date: Sep. 3, 1998

(30) Foreign Application Priority Data

Feb. 27, 1997 (FR) ..... 97/02814

(51) Int. Cl.[7] ..... G08G 1/123

(52) U.S. Cl. ..... 340/988; 701/224; 701/301; 33/351

(58) Field of Search ..... 340/988, 984, 340/985, 986, 987; 33/317 R, 320, 349, 351, 352, 354; 114/144 RE; 701/224, 301

(56) References Cited

U.S. PATENT DOCUMENTS 3,888,201 6/1975 Zuvela ..... 114/144 R
4,179,741 * 12/1979 Rossani ..... 364/457
4,336,596 * 6/1982 Martin ..... 364/559
4,725,957 * 2/1988 Alberter et al. ..... 364/457
4,791,729 * 12/1988 Suda ..... 33/356
5,287,295 * 2/1994 Ives et al. ..... 33/361
5,313,397 * 5/1994 Singh et al. ..... 364/457
5,357,437 * 10/1994 Polvani ..... 364/449
5,440,303 * 8/1995 Kinoshita ..... 340/988

FOREIGN PATENT DOCUMENTS 2 643 607 8/1991 (FR) .
2 695 904 3/1994 (FR) .

* cited by examiner

*Primary Examiner*—Daniel J. Wu
*Assistant Examiner*—John Tweel, Jr.
(74) *Attorney, Agent, or Firm*—Allen, Dyer, Doppelt, Milbrath & Gilchrist, P.A.

(57) ABSTRACT

A device alters a course of a watercraft including an automatic pilot with a magnetic compass. The device includes at least two coils positioned adjacent the magnetic compass, and an excitation circuit for exciting each of the two coils. The device further includes a control circuit for controlling the excitation circuit as a function of a course signal and a boat list signal so that the magnetic compass is rotated counter-clockwise to a predetermined direction when a listing of the watercraft is to starboard, and is rotated clockwise to the predetermined position when the listing of the watercraft is to portside.

49 Claims, 5 Drawing Sheets

DEVICE FOR ALTERING THE COURSE OF A BOAT

FIELD OF THE INVENTION

The present invention relates to a device to alter the path of a boat having an automatic pilot with a magnetic compass that is activated upon the reception of an alarm signal and comprises means to fix the compass of the automatic pilot on a fictitious North.

There is a security device of the above type already known from the international patent application WO 94/06679. This security device is now being commercially distributed under the reference ADSM "Sea Rescue Apparatus" by the firm ADSM Inc., Miami, Fla. It requires no physical connection to the automatic pilot and may be installed on every type of boat.

Figure 1:
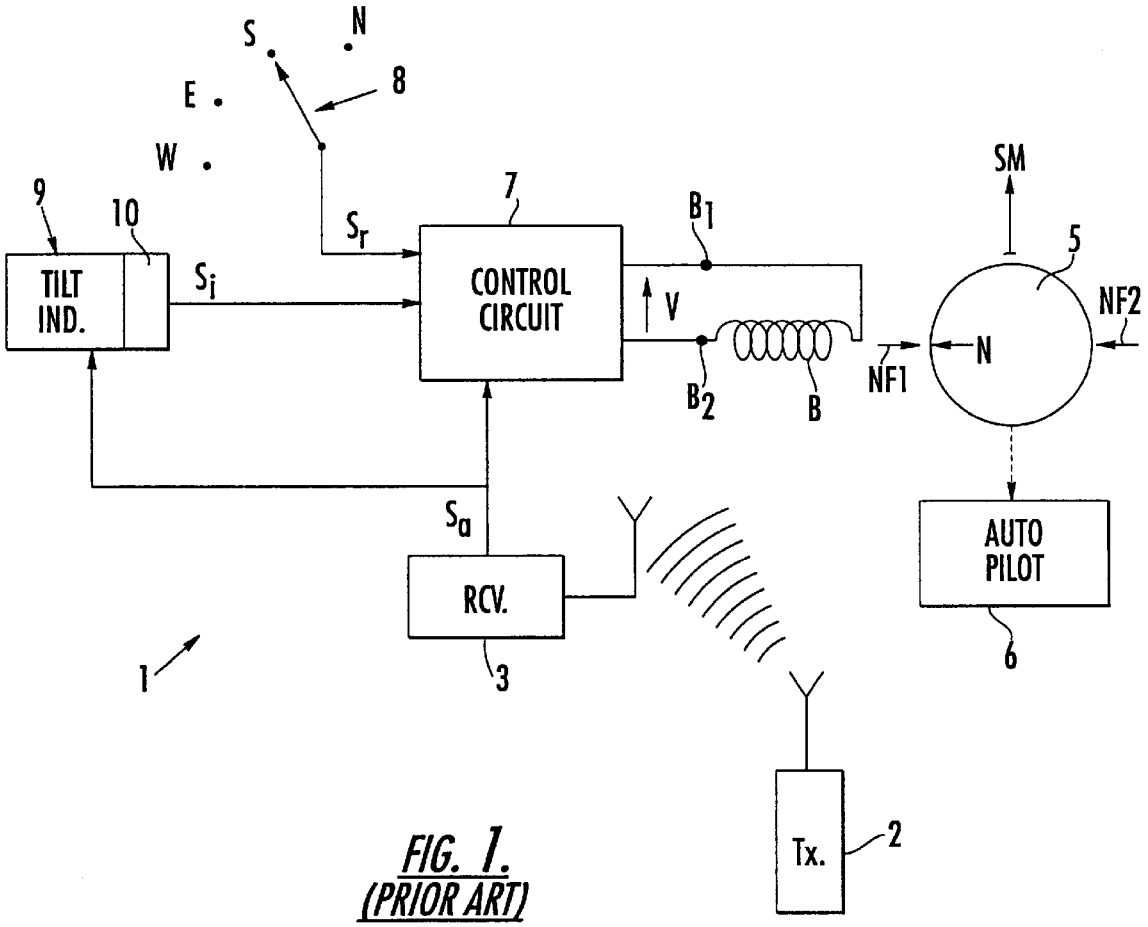
FIG. 1. (PRIOR ART)

As can be seen in FIG. 1, the safety device 1 that is commercially distributed has at least one transmitter 2 carried by the navigator, sending a radio signal, an on-board receiver 3, a coil B in the vicinity of the magnetic compass 5 of the automatic pilot 6 and a circuit 7 for the control of the coil. The control circuit 7 receives a list signal Si and a course signal Sr at input. The course signal Sr is delivered by a selector switch 8 with four positions N (North), S (South), W (West) and E (East). The list signal Si is delivered by a tilt indicator 9 provided with an integrator circuit 10 and represents the mean direction of listing of the boat, portside (wind on starboard) or starboard (wind on portside).

When the receiver 3 no longer receives the radio signal, it activates an alarm signal Sa that activates the control circuit 7 and locks the listing signal Si to the output of the tilt indicator 9. The circuit 7 then sends an excitation voltage V (or a current) into the coil so as to create a fictitious North which fixes the compass 5 in a specified position. By reaction, the automatic pilot 6 makes the boat turn so as to retrieve the lost course, in such a way that the boat keeps going around in circles so long as the alarm signal Sa is maintained.

Table 1 here below gives a more detailed description of the working of the device 1 By convention, the coil is placed to the left of the compass, namely on the portside. The direction of movement SM of the boat is identified by an arrow in FIG. 1. Depending on the sign of the excitation voltage V, the coil creates a fictitious North NF1 on portside or a fictitious South on portside equivalent to a fictitious North NF2 on starboard side.

TABLE 1

| Course (Sr) | Listing (Si) | Fictitious North | Turning |
|---|---|---|---|
| North (N) | starboard | NF1 | portside |
| | portside | NF2 | starboard |
| South (S) | starboard | NF2 | portside |
| | portside | NF1 | starboard |
| East (E) | — | NF2 | variable |
| West (W) | — | NF1 | variable |

Since it is necessary to obtain a minimum rudder angle of 30° in an emergency, the fictitious North dictated by the coil is imperatively at starboard (NF2) when the boat is heading East. Indeed, in this case, the magnetic North of the compass is oriented towards the coil as shown in FIG. 1 so that a portside fictitious North (NF1) would not make the compass rotate. For the same reason, the fictitious North is imperatively oriented to the portside (NF1) when the boat is heading substantially towards the West. In both these directions, the list signal Si is not taken into account as can be seen in Table 1.

In the case of a sail boat, when there are strong winds, it is desirable however, in order to prevent the breaking of the boom by jibing, that the boat should not veer downwind. The boat should therefore preferably veer against the wind.

This problem, identified in the international patent application WO 94/06679 has not been resolved to date except when the boat is heading substantially Northwards or substantially Southwards. On the contrary, when the boat is heading substantially Eastwards or substantially Westwards (with the selector switch in the East or West position), the sense of the turn made by the boat when the alarm signal Sa is activated is not controlled. Depending on the exact position of the compass when the safety device is activated, the boat may turn to starboard or port when the selector switch 8 is in the East or West position.

The present invention seeks especially to overcome this drawback.

More particularly, a general goal of the present invention is to provide for a device to alter the course of a boat that takes account of the direction of the list whatever the course being followed.

This goal is achieved by means of a device to alter the course of a boat of the type described here above, wherein the means to fix the compass comprise two coils positioned in the vicinity of the compass along complementary axes, means to excite each of the coils and means to distribute the excitation of the coils as a function of a course signal and a boat list signal, arranged to take the compass into a fixed position in making it turn preferably counter-clockwise when the listing is to starboard and clockwise when the listing is to port.

Preferably, the coils are arranged so as to make the compass rotate by an angle at least equal to 45° whatever the course taken by the boat. For example, the device may include two coils positioned in substantially orthogonal axes.

According to one embodiment, the means for distributing the excitation of the coils comprise means for selecting either one of the coils as a function of the course signal, and means for delivering a signal for the excitation of the selected coil, the polarity of which is a function of the course signal or of the listing signal.

According to one embodiment, the means for distributing the excitation of the coils comprise means for the simultaneous application, to each of the coils, of an excitation signal whose value and polarity are determined as a function of the course signal and of the list signal.

Advantageously, the means for simultaneously applying an excitation signal to each of the coils comprise a memory receiving the course signal and the listing signal at its address inputs.

According to one embodiment, the course signal is delivered by a selector switch or a manual selector. The course signal may be encoded in the form of a binary word.

According to one embodiment, the device of the invention comprises an automatic detector of the terrestrial magnetic North, delivering a divergence signal representing the angle between the terrestrial magnetic North and a reference axis of the boat, and a computation means receiving the list signal and the divergence signal at input, arranged to deliver weighted signals for the excitation of each of the coils.

The present invention also relates to an anticollision system for a boat equipped with an automatic pilot with magnetic compass, comprising a device for the detection of obstacles delivering an alarm signal when an obstacle is detected, and a device to alter the course of the boat in accordance with the present invention, controlled by the alarm signal delivered by the obstacle detection device.

Figure 2:
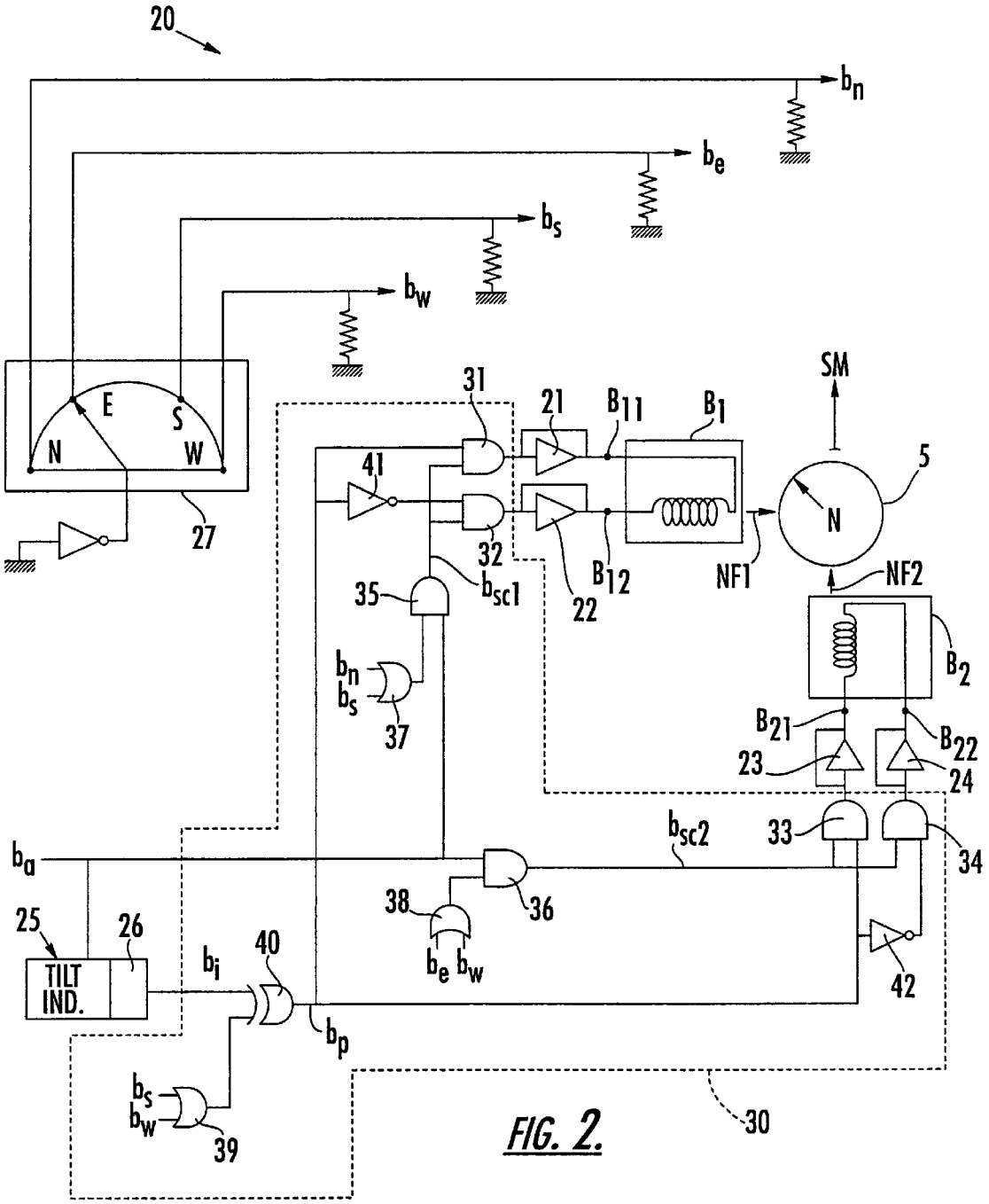
Figure 3:
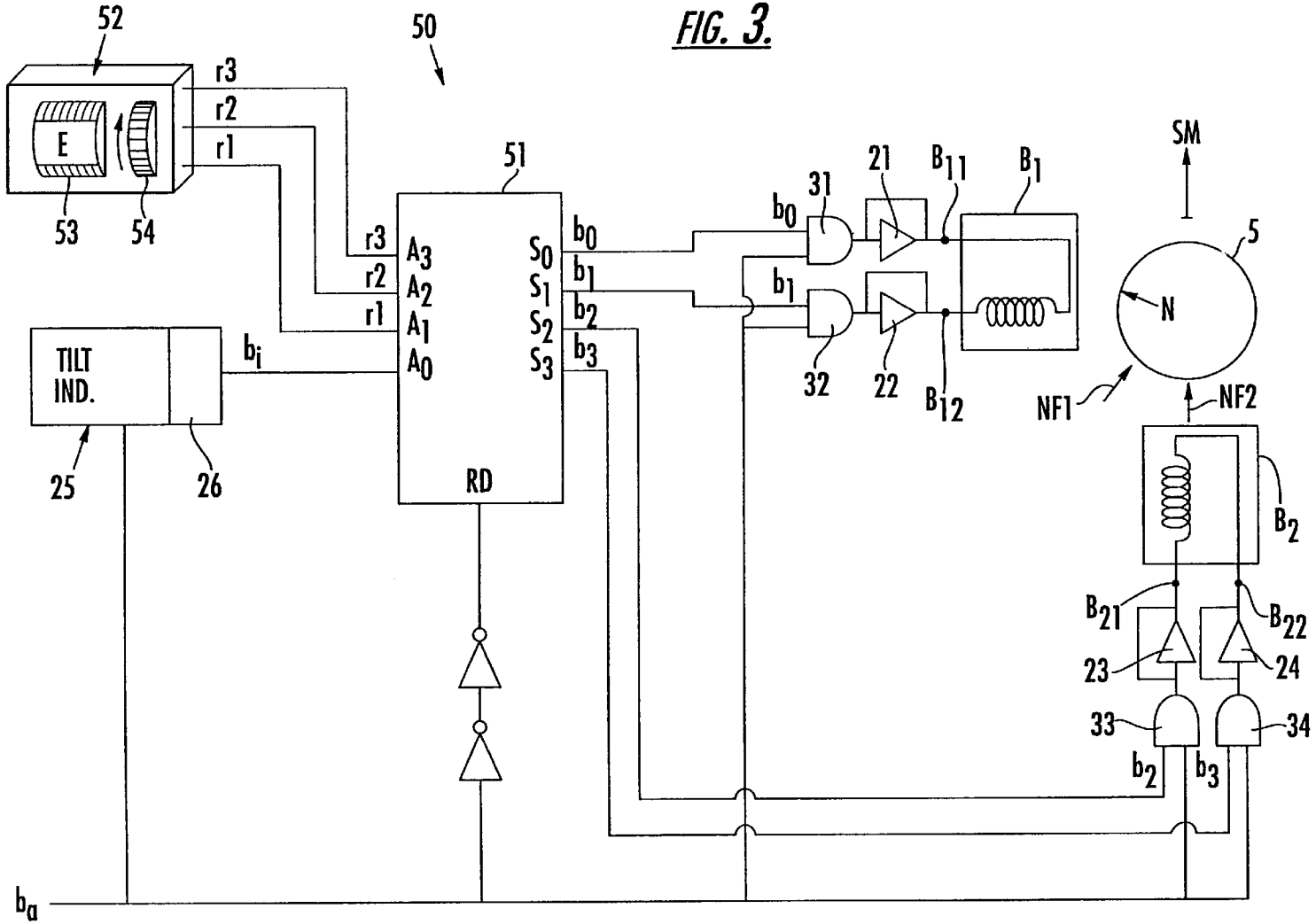
Figure 4:
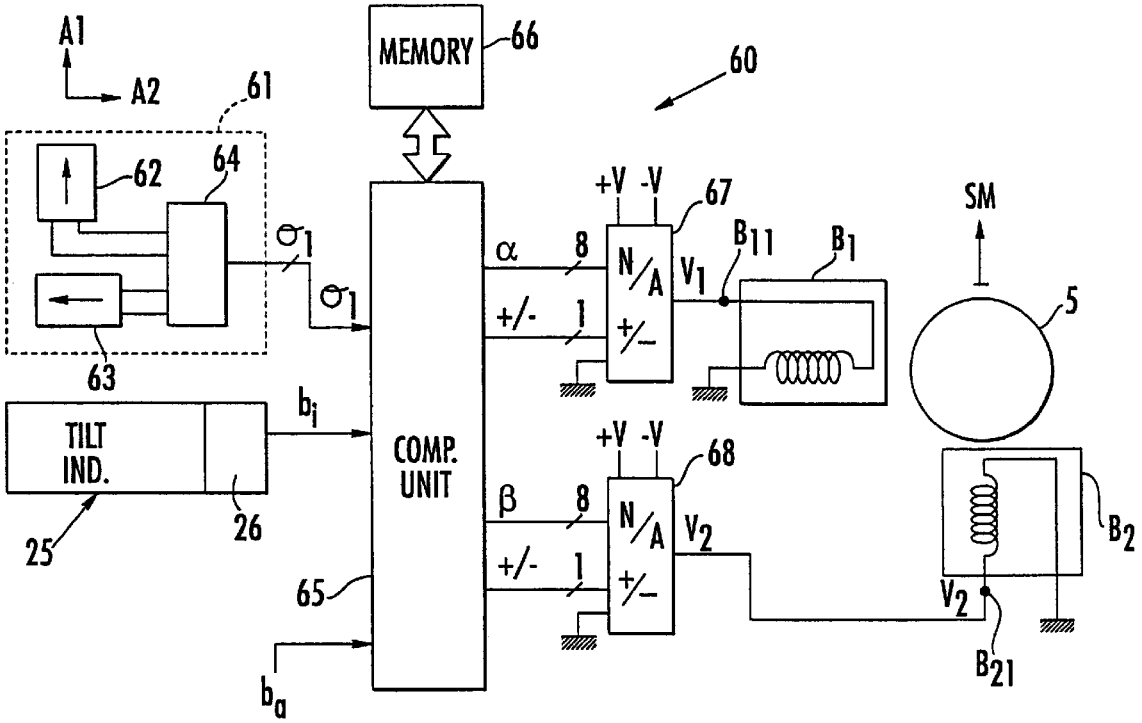
Figure 5:
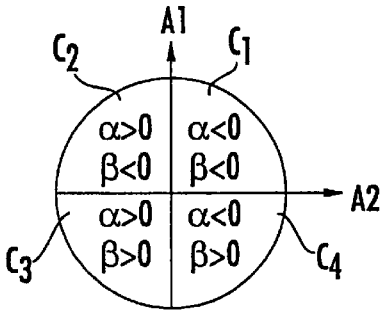
Figure 6:
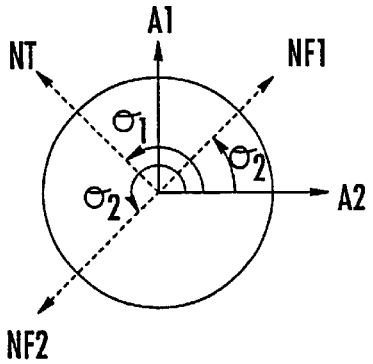
Figure 7:
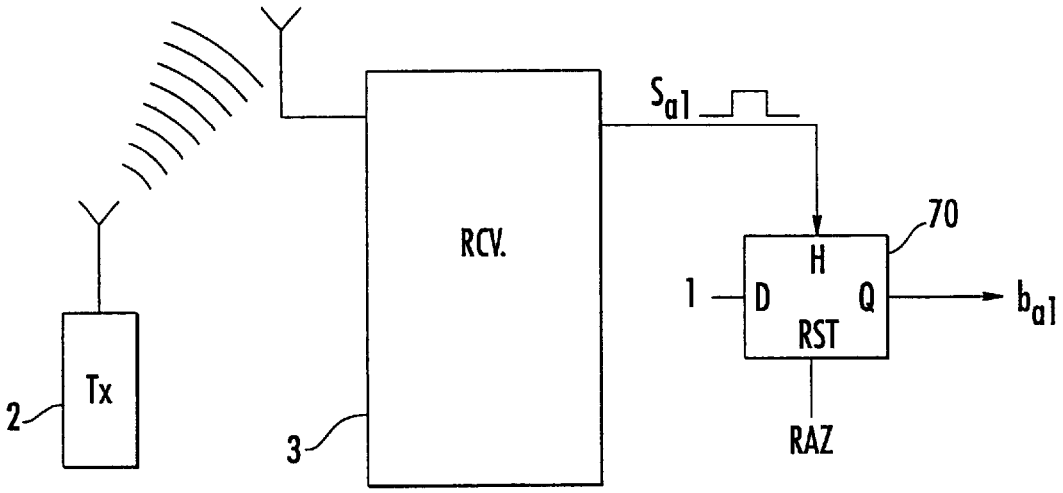
Figure 8:
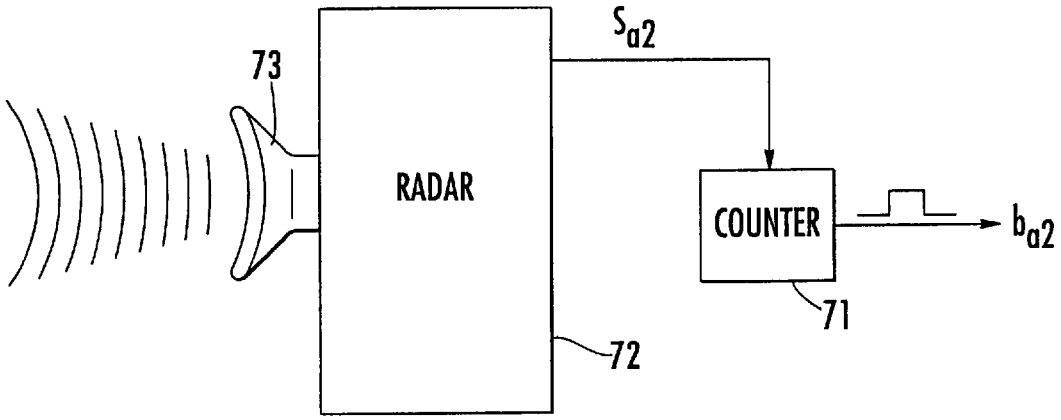

These characteristics, advantages, applications as well as other features of the present invention shall be explained in greater detail in the following description of three exemplary embodiments of a device for altering the course of a boat according to the invention and two applications of the device of the invention in relation with the appended figures, of which:

FIG. 1 shows a safety device according to the prior art and has been described here before, FIG. 2 is an electrical diagram of a first embodiment, using logic gates, of a device according to the invention, FIG. 3 is an electrical diagram of a second embodiment of a device according to the invention, bringing into play a program memory, FIG. 4 is a block diagram of a third embodiment of a device according to the invention bringing into play a computation unit, FIGS. 5 and 6 illustrate a method according to the invention implemented by the device of FIG. 4, FIG. 7 illustrates a standard application of the device according to the invention, and FIG. 8 illustrates an application according to the invention of the device of the invention.

It will be noted that the views shown in FIGS. 1 to 4 are in the plane of the bridge of a boat. The direction of movement SM of the boat is identified by an arrow.

FIG. 2 shows a device 20 according to the invention enabling action on the compass 5 of the automatic pilot of a boat upon the reception of an alarm signal, in this case an alarm bit ba. Essentially, the device 20 comprises two coils B1, B2, means of excitation of the coils B1, B2 herein taking the form of four follower amplifiers 21, 22, 23, 24 and a circuit 30 for the control of the amplifiers 21 to 24. The output of the amplifier 21 is connected to a terminal B11 of the coil B1 and the output of the amplifier 22 is connected to the other terminal B12 of the coil B1. The output of the amplifier 23 is connected to a terminal B21 of the coil B2 and the output of the amplifier is connected to the other terminal B22 of the coil B2. The coils B1, B2 are positioned in the vicinity of the compass 5, respectively on the portside and astern. Here, the magnetic axes of the coils are orthogonal.

The control circuit 30 receives the alarm bit ba, a listing bit bi delivered by a standard type of tilt indicator 25 provided with an integrator stage 26 and four course bits bn, be, bs, bw delivered by a selector switch 27 with four positions N, E, S, W at input. The bit bn, be, bs, bw corresponding to the selected course sector is at 1 and all the others are at 0.

The circuit 30 comprises various logic gates among which there are six AND gates 31 to 36, three OR gates 37 to 39 and one XOR gate 40. The gates 31, 32, 33, and 34 drive the amplifiers 21, 22, 23 and 24. The gate 39 receives the bits bs, bw at input and its output is applied to the gate 40, whose other input receives the listing bit bi. The gate 40 delivers a polarity bit bp applied to the gates 31 and 33 as well as to the gates 32, 34 by means of inverter gates 41, 42. The gate 37 receives the bits bn, bs at input and the gate 38 receives the bits be, bw. The output of the gate 37 is applied to the gate 35 whose other input receives the alarm bit ba. The output of the gate 38 is applied to the gate 36 whose other input receives the bit ba. The output of the gate 35 delivers a bit bsc1 for the selection of the coil B1 that is applied to the free inputs of the gates 31, 32. The output of the gate 36 delivers a bit bsc2 for the selection of the coil B2 that is applied to the free inputs of the gates 33, 34.

The gates 35, 36 act as inhibitors of the circuit 30 and are transparent only if the alarm bit ba is at 1. So long as the alarm bit is at 0, the control circuit 30 is blocked and the coils B1, B2 receive a zero voltage. When the bit ba goes to 1, the bits bsc1 and bsc2 select one of the coils B1 or B2 and the bit bp determines the polarity of the excitation voltage applied to the selected coil. The follower amplifiers 21 to 24 convert the logic 1 into an excitation voltage V and the logic 0 into a zero voltage or ground.

The following Table 2 describes the working of the control circuit 30 when the alarm bit ba is at 1. By convention, the list bit bi is at 0 when the boat is listing to starboard and at 1 when it is listing to portside. The voltage VB1 at the terminals of the coil B1 is defined as being positive when the voltage V is applied to the terminal B11 and negative when the voltage V is applied to the terminal B12. The same convention is chosen for the coil B2, whose excitation voltage is designated as VB2. By convention again, the sense of the winding of the coil Bi is chosen to create a starboard fictitious North when the voltage VB1 is positive and a portside fictitious North when the voltage VB1 is negative. The sense of the winding of the coil B is chosen to create a fictitious North on the bow side when the excitation voltage VB2 is positive and a fictitious North astern when the voltage VB2 is negative.

TABLE 2

| SM | bi | bw | bs | bn | be | bp | bscl | bsc2 | VB1 | VB2 |
|---|---|---|---|---|---|---|---|---|---|---|
| E | 0 | 0 | 0 | 0 | 1 | 0 | 0 | 1 | — | −V |
| N | 0 | 0 | 0 | 1 | 0 | 0 | 1 | 0 | −V | — |
| S | 0 | 0 | 1 | 0 | 0 | 1 | 1 | 0 | +V | — |
| W | 0 | 1 | 0 | 0 | 0 | 1 | 0 | 1 | — | +V |
| E | 1 | 0 | 0 | 0 | 1 | 0 | 0 | 1 | — | +V |
| N | 1 | 0 | 0 | 1 | 0 | 1 | 1 | Q | +V | — |
| S | 1 | 0 | 1 | 0 | 0 | 1 | 1 | 0 | −V | — |
| W | 1 | 1 | 0 | 0 | 0 | 0 | 0 | 1 | — | −V |

Whatever the route being followed, the fictitious North created by either one of the coils B1, B2 always imposes a rotation that depends on the direction of listing on the compass, ensuring that the boat goes against the wind.

To get a clear picture, it shall be assumed by way of an example that the boat is heading towards the Northeast with a starboard list (bi=0). The magnetic North N of the compass 5 is in the position shown in FIG. 2. The user may position the course selector switch 27 on the North (first case, bn=1) or on the East (second case, be=1).

First Case

Northeast Course, Position N, Starboard Listing

If an alarm is activated (ba=1), the coil B1 is selected and creates a fictitious North NF1 astern. The compass rotates in the counter-clockwise sense and performs a 45° rotation. The boat turns to port with a rudder angle of 45° in going against the wind, as desired.

Second Case

Northeast Course, Position E, Starboard Listing

If an alarm is activated (ba=1), the coil B2 is selected and creates a fictitious North NF2 astern. The compass turns counter-clockwise and performs a 135° rotation. The boat turns portside with a maximum rudder angle of 90° in going against the wind, as desired.

Thus, advantageously, the device of the invention, in all circumstances, imposes a counter-clockwise rotation (portside turn) on the compass when the listing is starboard and in the clockwise sense (starboard turn) when the listing is portside.

In the foregoing example, it will be noted that the rudder angle obtained in the event of an alarm is at least equal to 45° but is still not the maximum (90°) when the courses followed are intermediate, namely Northeast, Southeast etc., and other courses which are not provided for on the selector switch 27.

FIG. 3 shows an embodiment of the present invention, that makes it possible to obtain a rudder angle at least equal to 67.5° whatever the course followed.

The device 50 can be distinguished from the embodiment that has just been described by the fact that the control circuit for the coils, made here above by means of logic gates, takes the form of a ROM, EPROM or EEPROM type remanent memory 51. The memory 51 herein comprises eight words of four bits each. The AND gates 31, 32, 33, 34 which drive the amplifiers 21, 22, 23, 24 are kept but, at input, they receive the alarm bit ba and a bit taken at the output of the memory, respectively b0, b1, b2, b3. The selector switch described further above is replaced by a course selector 52 with eight positions N, NE, E, SE, S, SW, W and NW. The selector 52 is provided with a screen 53 for displaying the selected course (or course sector) and a selection knob 54. The selected course is delivered in the form of a binary word encoded on three bits r1, r2, r3. The bits r1, r2, r3 are applied to the most significant address inputs A1, A2, A3 of the memory 51 whose least significant address input A0 receives the listing bit bi. The alarm bit ba is applied to the read control input RD of the memory 51 by means of two inverter gates introducing a slight delay.

When the alarm bit ba appears, the bit bi is latched to the output of the tilt indicator 25 and the memory 51 receives the word bi, r1, r2, r3 at input. The alarm bit ba then activates the reading of the memory whose outputs S0 to S3 deliver the bits b0 to b3, applied to the gates 31 to 34. It will be noted that the gates 31 to 34 herein do not have the function of selecting one or other of the coils B1 and B2, the coils possibly being excited simultaneously and being used only to inhibit the device 50 when the alarm ba is at 0. The memory 51 is used as a correspondence table between the input parameters of the device 50, herein the bits bi and r1, r2, r3, and the excitation signals to be applied to the coils.

The following Table 3 gives an example of the programming of the memory 51 and of the excitation voltages obtained. It can be seen that the device 50 works like that of FIG. 2 when the courses N, S, E, W are chosen. It offers the additional advantage of a combined excitation of the coils B1, B2 when the courses NE, SE, NW, SW are selected.

TABLE 3

| | address inputs | | | | memory contents | | | | excitation of coils | |
|---|---|---|---|---|---|---|---|---|---|---|
| SM | r3 | r2 | r1 | bi | b0 | b1 | b2 | b3 | VB1 | VB2 |
| N | | 000 | | 0 | | 0100 | | | −V | — |
| | | | | 1 | | 1000 | | | +V | — |
| NE | | 001 | | 0 | | 0101 | | | −V | −V |
| | | | | 1 | | 1010 | | | +V | +V |
| E | | 010 | | 0 | | 0001 | | | — | −V |
| | | | | 1 | | 0010 | | | — | +V |
| SE | | 011 | | 0 | | 1001 | | | +V | −V |

TABLE 3-continued

| | address inputs | | | | memory contents | | | | excitation of coils | |
|---|---|---|---|---|---|---|---|---|---|---|
| SM | r3 | r2 | r1 | bi | b0 | b1 | b2 | b3 | VB1 | VB2 |
| | | | | 1 | | 0110 | | | −V | +V |
| S | | 100 | | 0 | | 1000 | | | +V | — |
| | | | | 1 | | 0100 | | | −V | — |
| SW | | 101 | | 0 | | 1010 | | | +V | +V |
| | | | | 1 | | 0101 | | | −V | −V |
| W | | 110 | | 0 | | 0010 | | | — | +V |
| | | | | 1 | | 0001 | | | — | −V |
| NW | | 111 | | 0 | | 0110 | | | −V | +V |
| | | | | 1 | | 1001 | | | +V | −V |

To get a clear picture, it shall be assumed by way of an example that the boat is heading East/Northeast with a starboard list (bi=0). The magnetic North N of the compass 5 is then in the position shown in FIG. 3. The user may position the course selector 52 on the North (first case, bn=1) or on the East (second case, be=1).

First Case

East/Northeast Course, Position NE, Starboard Listing

If an alarm is activated (ba=1), the coils B1 and B2 are activated simultaneously. The coil B1 creates a first fictitious North portside and coil B2 creates a second fictitious North astern. The resultant fictitious north NF1 is oriented 45° stern portside. The compass rotates in the counter-clockwise sense and performs a 67.5° rotation. The boat turns to port with a rudder angle of 67.5° in going against the wind.

Second Case

East/Northeast Course, Position E, Starboard Listing

If an alarm is activated (ba=1), only the coil B2 is selected and creates a fictitious North NF2 on the stern side. The compass turns counter-clockwise and performs a 112.5° rotation. The boat turns portside with a maximum rudder angle of 90° in going against the wind.

Ultimately, it is seen that, in the worse case, the rudder angle is at least 67.5°.

It will clearly be seen by those skilled in the art that the device according to the invention can be the object of various other alternative embodiments and variants. In particular, the course selector may have several selection positions delivering a course signal encoded on more than three bits, for example eight bits (256 values), and comprises a digital keyboard used to enter the course that is followed. The memory 51 may contain a large number of excitation values enabling the obtaining of a minimum rudder angle close to 90° whatever the course followed. Also, several coils oriented along to complementary axes may be planned, for example three coils oriented at 120° or four coils oriented at 90°.

In general, a minor drawback of the device that has just been described is that it cannot be protected against errors that may be made by the user in selecting the course followed. For example, if the user selects the course NE on the selector 52 whereas the automatic pilot of the boat is programmed on the course SE, it is obvious that the device according to the invention will alter the course of the boat erroneously if the alarm is activated.

FIG. 4 shows an ultimate improvement of the device of the invention in which it is no longer necessary for the user to take action and the rudder angle is always kept at its maximum value of 90°.

The device 60 shown in FIG. 4 comprises a course detector 61 that is entirely automatic and a computation unit 65 equipped with a memory 66. The computation unit 65 may be a microprocessor or a wired logic microprogrammed applications specific circuit.

The course detector 61 comprises two micromagnetometers 62, 63 arranged to detect the two components of the earth's magnetic field according to two axes of Cartesian coordinates, in this case an axis A1 oriented in the direction of movement SM and a transversal axis A2 oriented to starboard. The magnetometers 62, 63 are associated with a processing circuit 64 which gives the computation unit 65 a digital signal θ1 representing the angle between the terrestrial magnetic North and a reference axis of the boat, for example the axis A2.

The computation unit 65 also receives the alarm bit ba and the listing bit bi and drives the coils B1, B2 by means of two digital/analog converters 67, 68. The output of the converter 67 is connected to the terminal B11 of the coil B1 and the output of the converter 68 is connected to the terminal B21 of the coil B2, the terminals B12 and B22 being connected to the ground. The converters 67, 68 are full-scale converters enabling the application of the positive or negative voltages V1, V2 to the coils B1, B2. The computation unit 65 sends a weighting parameter α and a sign bit to the input of the converter 67 and a weighting parameter β and a sign bit to the input of the converter 68. The parameters α and β are herein 8-bit words.

Thus, the excitation of the coils B1, B2 is done in a weighted manner through the converter 67, 68 and through the parameters α, β, so that the computation unit 65 is capable, when an alarm is activated, of creating a fictitious North at 90° to the terrestrial magnetic North, whatever the course followed, ensuring a rudder angle that is always equal to 90°.

A description shall now be given, by way of a non-restrictive example, of a method enabling this result to be obtained. To simplify the implementation of this method, the magnetic axes of the coils B1, B2 are respectively positioned along the axes A1, A2 of the course detector 61.

Step 1

When the alarm bit ba goes to 1, the computation unit 65 reads the listing bit bi at the output of the tilt indicator 25 and the value of the angle θ1 at the output of the detector 61. The unit 65 then computes an angle θ2 equal to θ1−Π/2 if the listing is to portside (bi=1) or equal to θ1+Π/2 if the listing is to starboard (bi=0). The angle θ2, in the system of axes A1, A2, shows the orientation of the fictitious magnetic North that has to be created. The angle Π/2 represents the minimum value to be added to the angle θ1 to obtain a rudder angle of 90°. This value may however be smaller than Π/2 if it is desired to have a rudder angle of less than 90°.

Step 2

The computation unit then defines the signs of the parameters α and β in determining, by means of the angle θ2, the quadrant C1, C2, C3, C4 in which the fictitious North to be generated is located. The quadrants C1 to C4 are represented by Table 4 here below as well as in FIG. 5.

TABLE 4

| Quadrant C2 | Quadrant C1 |
|---|---|
| $90° < \theta 2 \leqq 180°$<br>$\alpha > 0, \beta < 0$ | $0 < \theta 2 \leqq 90°$<br>$\alpha < 0, \beta < 0$ |
| **Quadrant C3** | **Quadrant C4** |
| $180° < \theta 2 \leqq 270°$<br>$\alpha > 0, \beta > 0$ | $270° < \theta 2 \leqq 360°$<br>$\alpha < 0, \beta > 0$ |

The quadrants C1 to C4 directly give the sign of α (or sign of the voltage V1) and β (or sign of the voltage V2) for a sense of winding of the coils that is chosen by convention. In practice, this step 2 is achieved in the form of a test loop.

Step 3

Once the signs of the parameters α and β have been determined, the unit 65 computes positive parameters K1 and K2 such that:

$$K1=|\text{sine}\ (\theta 2)|$$

$$K2=|\cos\ (\theta 2)|$$

and computes α and β as follows:

$$\beta=255\ K1$$

$$\alpha=255\ K2$$

the number 255 representing the full scale of the 8-bit converters 67, 68.

Step 4

The computation unit applies the computed values of the parameters α, β as well as the sign bits determined in the step 2 to the converters 67 and 68. The coils B1 and B2 receive the weighted voltages V1 and V2 and create a fictitious North at 90° to the terrestrial magnetic North, making the compass rotate by 90°. Since the device is locked throughout the duration of the alarm, the subsequent rotation of the boat does not affect the voltages V1, V2.

It will clearly be seen by those skilled in the art that this method can be implemented in a very simple way. In particular, the determining of the sine and cosine of the angle θ2 can be done by a standard approximate computation algorithm or, in an even simpler manner, by means of a table of discrete values stored in the memory 66. In this case, it is not necessary for the computation unit 65 to work on angles expressed in radians or in degrees. For example, if the angle θ1 sent by the course detector 61 is encoded on eight bits, this angle may be expressed in a simplified system of measurement where the angle of 360° corresponds to the value 255. Also, by analogy with the embodiment of FIG. 3, it is possible to store a table of data in the memory 66 directly giving the values of the parameters α; β as a function of the angle θ1 and of the listing bit bi.

By way of an example, FIG. 6 gives a view, for any orientation of the terrestrial magnetic North NT, of the fictitious North NF1 obtained when the listing is at portside and the fictitious North NF2 obtained when the listing is at starboard. It can be seen that the fictitious North NF1 or NF2 is oriented to 90° of the terrestrial magnetic North, not counting the computation precision. Furthermore, the veering imposed on the boat is a function of the listing, in accordance with the primary objective of the present invention.

Here above, we have described three exemplary embodiments of a device according to the invention making it possible to alter the course of a boat equipped with an automatic pilot with magnetic compass. It is clear that the present invention can have various other alternative embodiments. In particular, the characteristics of each of the embodiments described may be combined to create yet other embodiments. For example, the course detector 61 of FIG. 4 may replace the manual selector of FIG. 3. For this purpose, it is appropriate to alter the processing circuit 64 so that, instead of the angle θ1, it delivers discrete values of the course followed. Again, the computation unit of FIG. 4 may be combined with a manual course selector, etc.

Furthermore, the present invention can undergo various applications.

According to a standard application shown in FIG. 7, the alarm bit, herein designated as ba1, is delivered by the Q output of a latch 70 whose D input is at 1. The flip-flop circuit 70 is driven at its clock input H by an alarm signal Sa1 delivered by the RF receiver 3 described in the introduction, which monitors one or more transmitters 2 carried by those who are on board. When the alarm signal Sa1 is activated, the bit ba1 is kept at 1 so long as the flip-flop circuit 70 is not reset, so that the boat goes round in circles.

FIG. 8 shows an application that comes within the framework of the present invention. The alarm bit, herein designated as ba2, is delivered for a specified duration (for example equal to some seconds) by a counter 71 or any other equivalent means. The activation of the counter 71 is prompted by an acoustic or electrical alarm signal Sa2 sent by an obstacle detection device 72. The device 72 is itself conventional and comprises for example a radar 73. Together, the device according to the invention and the obstacle detection device 72 form an anti-collision system that is simple to implement and provides great security. Thus, when an obstacle is detected and when the alarm signal Sa2 is sent, the bit ba2 is temporarily set at 1 by the counter 71. The boat makes a turn to avoid the obstacle and then resumes its normal course when the bit ba2 goes back to 0. If the alarm signal Sa2 is still present, a new cycle for the sending of the bit ba2 can be planned.

Naturally, the two applications that have just been described can be combined by sending the bits ba1 and ba2 into an OR logic gate. Also, other applications may be combined. The alarm bit may be generated by a computer link, a telephone link, etc. or again it may be generated manually by means of an emergency button placed for example in the steering cabin.

Finally, although the device of the invention has been designed to impose a turn against the wind in order to prevent any breaking of the boom by jibing, it must be noted that its operation can be modified in exceptional cases. For example, if the device of the invention is associated with an obstacle detection device capable of detecting the position of an obstacle in relation to the course followed, it may prove to be preferable to choose the sense of the turn as a function of the position of the obstacle and not as a function of the sense of the listing. This result may be obtained in a simple way with the embodiment of FIG. 4 by sending the computation unit 65 a obstacle bit bp that has priority over the listing bit bi, the value 1 or 0 of the obstacle bp representing the position of the obstacle, front portside or front starboard.

What is claimed is:

1. A device for altering a course of a watercraft including an automatic pilot with a magnetic compass, the device comprising:

at least two coils positioned adjacent the magnetic compass;

excitation means for exciting said at least two coils; and control means for controlling said excitation means as a function of a course signal and a boat list signal so that the magnetic compass is rotated counter-clockwise to a predetermined direction when a listing of the watercraft is to starboard, and is rotated clockwise to the predetermined position when the listing of the watercraft is to portside, said control means being responsive to an alarm signal.

2. A device according to claim 1, wherein said control means excites said at least two coils so that the magnetic compass rotates by an angle equal to at least 45° independent of the course of the watercraft.

3. A device according to claim 1, wherein said at least two coils comprises two coils orthogonally positioned to each other.

4. A device according to claim 1, wherein said control means comprises:

selection means for selecting one of said at least two coils as a function of the course signal; and signal means for generating an excitation signal for exciting the selected coil, a polarity of the excitation signal is a function of the course signal or the list signal.

5. A device according to claim 1, wherein said control means comprises selection means for simultaneously applying an excitation signal to each of said at least two coils having a value and a polarity that is a function of the course signal and the list signal.

6. A device according to claim 5, wherein said selection means comprises a memory having address inputs for receiving the course signal and the list signal.

7. A device according to claim 1, further comprising a selector switch for selecting the course signal.

8. A device according to claim 1, wherein the course signal is encoded as a binary word.

9. A device according to claim 1, further comprising a divergence signal generator for detecting a terrestrial magnetic North and generating a divergence signal representing an angle between the terrestrial magnetic North and a reference axis of the watercraft; and wherein said control means includes an input for receiving the list signal and the divergence signal for generating weighted signals in response thereto for exciting said at least two coils.

10. A device according to claim 1, further comprising a detection system for detecting when a person falls overboard, the alarm signal being generated responsive to said detection system.

11. A device according to claim 1, further comprising an obstacle detection system for detecting obstacles in the course of the watercraft, the alarm signal being generated responsive to said obstacle detection system.

12. An anti-collision system for a watercraft comprising:

an automatic pilot comprising a magnetic compass;

an obstacle detection device for detecting an obstacle in a course of the watercraft and generating an alarm signal in response thereto;

a device for altering the course of the watercraft responsive to the alarm signal, said device comprising at least two coils positioned adjacent the magnetic compass, an excitation circuit for exciting each of said at least two coils, and a control circuit for controlling said excitation circuit as a function of a course signal and a boat list signal so that the magnetic compass is rotated counter-clockwise to a predetermined direction when a listing of the watercraft is to starboard, and is rotated clockwise to the predetermined position when the listing of the watercraft is to portside.

13. An anti-collision system according to claim 12, wherein said control circuit excites said at least two coils so that the magnetic compass rotates by an angle equal to at least 45° independent of the course of the watercraft.

14. An anti-collision system according to claim 12, wherein said at least two coils comprises two coils orthogonally positioned to each other.

15. An anti-collision system according to claim 12, wherein said control circuit comprises:

a selection circuit for selecting one of said at least two coils as a function of the course signal; and a signal generator for generating an excitation signal for exciting the selected coil, a polarity of the excitation signal is a function of the course signal or the list signal.

16. An anti-collision system according to claim 12, wherein said control circuit comprises a selection circuit for simultaneously applying an excitation signal to each of said at least two coils having a value and a polarity that is a function of the course signal and the list signal.

17. An anti-collision system according to claim 16, wherein said selection circuit comprises a memory having address inputs for receiving the course signal and the list signal.

18. An anti-collision system according to claim 12, further comprising a selector switch for selecting the course signal.

19. An anti-collision system according to claim 12, wherein the course signal is encoded as a binary word.

20. An anti-collision system according to claim 12, further comprising a divergence signal generator for detecting a terrestrial magnetic North and generating a divergence signal representing an angle between the terrestrial magnetic North and a reference axis of the watercraft; and wherein said control circuit includes an input for receiving the list signal and the divergence signal for generating weighted signals in response thereto for exciting said at least two coils.

21. An anti-collision system according to claim 12, further comprising a detection system for detecting when a person falls overboard and activating said device in response thereto.

22. A water navigation system for a watercraft comprising:

an automatic pilot comprising a magnetic compass; and a device for altering a course of the watercraft comprising two coils orthogonally positioned to each other adjacent the magnetic compass, an excitation circuit for exciting said two coils, and a control circuit for controlling said excitation circuit as a function of a course signal and a boat list signal so that the magnetic compass is rotated counter-clockwise to a predetermined direction when a listing of the watercraft is to starboard, and is rotated clockwise to the predetermined position when the listing of the watercraft is to portside, said control circuit being responsive to an alarm signal.

23. A water navigation system according to claim 22, wherein said control circuit excites said two coils so that the magnetic compass rotates by an angle equal to at least 45° independent of the course of the watercraft.

24. A water navigation system according to claim 22, wherein said control circuit comprises:

a selection circuit for selecting one of said two coils as a function of the course signal; and a signal generator for generating an excitation signal for exciting the selected coil, a polarity of the excitation signal is a function of the course signal or the list signal.

25. A water navigation system according to claim 22, wherein said control circuit comprises a selection circuit for simultaneously applying an excitation signal to each of said at least two coils having a value and a polarity that is a function of the course signal and the list signal.

26. A water navigation system according to claim 25, wherein said selection circuit comprises a memory having address inputs for receiving the course signal and the list signal.

27. A water navigation system according to claim 22, further comprising a selector switch for selecting the course signal.

28. A water navigation system according to claim 22, wherein the course signal is encoded as a binary word.

29. A water navigation system according to claim 22, further comprising a divergence signal generator for detecting a terrestrial magnetic North and generating a divergence signal representing an angle between the terrestrial magnetic North and a reference axis of the watercraft; and wherein said control circuit includes an input for receiving the list signal and the divergence signal for generating weighted signals in response thereto for exciting said two coils.

30. A water navigation system according to claim 22, further comprising a detection system for detecting when a person falls overboard, the alarm signal being generated responsive to said detection system.

31. A water navigation system according to claim 22, further comprising an obstacle detection system for detecting obstacles in the course of the watercraft, the alarm signal being generated responsive to said obstacle detection system.

32. A method for altering a course of a watercraft comprising an automatic pilot including a magnetic compass, the method comprising the steps of:

positioning at least two coils adjacent the magnetic compass; and controlling excitation of the at least two coils as a function of a course signal and a boat list signal so that the magnetic compass is rotated counter-clockwise to a predetermined direction when a listing of the watercraft is to starboard, and is rotated clockwise to the predetermined position when the listing of the watercraft is to portside.

33. A method according to claim 32, wherein the step of controlling comprises controlling the excitation so that the at least two coils rotate the magnetic compass by an angle equal to at least 45° independent of the course of the watercraft.

34. A method according to claim 32, wherein the at least two coils comprises two coils orthogonally positioned to each other.

35. A method according to claim 32, wherein the step of controlling comprises:

selecting one of the at least two coils as a function of the course signal; and generating an excitation signal for exciting the selected coil, a polarity of the excitation signal is a function of the course signal or the list signal.

36. A method according to claim 32, wherein the step of controlling comprises simultaneously applying an excitation signal to each of the at least two coils having a value and a polarity that is a function of the course signal and the list signal.

37. A method according to claim 32, further comprising the step of selecting the course signal using a selector switch.

38. A method according to claim 32, further comprising the step of encoding the course signal as a binary word.

39. A method according to claim 32, further comprising the step of detecting a terrestrial magnetic North and generating a divergence signal representing an angle between the terrestrial magnetic North and a reference axis of the watercraft; and wherein the step of controlling comprises generating weighted signals in response to the list signal and the divergence signal for exciting the at least two coils.

40. A method according to claim 32, further comprising the steps of:

detecting when a person falls overboard; and initiating the step of controlling responsive to detection of the person being overboard.

41. A method according to claim 32, further comprising the steps of:

detecting obstacles in the course of the watercraft; and initiating the step of controlling responsive to detection of an obstacle.

42. A device according to claim 1, further comprising a computation unit providing the course signal.

43. A device according to claim 1, further comprising a course detector providing the course signal.

44. A device according to claim 12, further comprising a computation unit providing the course signal.

45. A device according to claim 12, further comprising a course detector providing the course signal.

46. A device according to claim 22, further comprising a computation unit providing the course signal.

47. A device according to claim 22, further comprising a course detector providing the course signal.

48. A method according to claim 32, wherein the automatic pilot further comprises a computation unit for generating the course signal.

49. A method according to claim 32, wherein the automatic pilot further comprises a course detector for generating a course signal.

* * * * *